United States Patent [19]

Kachkarov et al.

[11] 4,238,245

[45] Dec. 9, 1980

[54] INSTALLATION FOR ELECTROHYDROBLASTING OF CASTINGS

[76] Inventors: Alexandr G. Kachkarov, prospekt Mira, 21b, kv. 45; Valery V. Prikhodko, ulitsa Chaikovskogo, 6a, kv. 54, both of Nikolaev, U.S.S.R.

[21] Appl. No.: 38,108

[22] Filed: May 11, 1979

[51] Int. Cl.[3] ..... B08B 3/10

[52] U.S. Cl. ..... 134/133; 134/184; 181/200

[58] Field of Search ..... 181/200, 203–204, 181/207, 294; 134/1, 133, 184

[56] References Cited

U.S. PATENT DOCUMENTS

| | | | |
|---|---|---|---|
| 3,083,716 | 4/1963 | Rowan et al. | 134/133 X |
| 3,276,539 | 10/1966 | Dear et al. | 181/204 |
| 3,295,541 | 1/1967 | Ummel | 181/207 X |
| 3,348,814 | 10/1967 | Shaw | 134/1 X |
| 3,957,252 | 5/1976 | Storz | 134/184 X |

FOREIGN PATENT DOCUMENTS

| | | | |
|---|---|---|---|
| 1100453 | 1/1968 | United Kingdom | 181/294 |
| 1303223 | 1/1973 | United Kingdom | 134/184 |

OTHER PUBLICATIONS

Gulyi, Equipment & Technology Using the Electro–Hydraulic Effect, Machinostroeniye Publishers, Moscow, 1977, pp. 58–59.

*Primary Examiner*—Robert L. Bleutge
*Attorney, Agent, or Firm*—Lackenbach, Lilling & Siegel

[57] ABSTRACT

An installation for electrohydroblasting of castings comprises a base, a bath placed on said base, a mechanism for feeding castings into the bath, an electrode, and a mechanism for introducting the electrode into the bath and a pulse current generator coupled electrically to the electrode. An insulated casing is mounted on the base over the bath. The insulated casing is built of a latticed framework whose openings are covered with slabs, each being formed with two metallic boxes, one inside the other, so that the ends of one box face a bottom of the other, box with a space formed between the bottoms, intended for a vibration-absorbing material to be fed thereto and with the metallic boxes being grounded.

8 Claims, 3 Drawing Figures

INSTALLATION FOR ELECTROHYDROBLASTING OF CASTINGS

BACKGROUND OF THE INVENTION

1. Field of the Invention

The invention relates to foundry practice, and more particularly to installations for electrohydroblasting of castings to remove core and moulding sands by using an electrohydraulic effect.

The term "electrohydraulic effect" is used to denote the action upon a solid body of pulse pressures induced by a high-voltage discharge in a liquid.

2. Description of the Prior Art

Among means intended for cleaning castings (in particular large ones, weighing from 100 to 40,000 kg and over) of core and moulding sands, distinguished for their high throughput capacity, economic performance, capability for practically complete cleaning of variously shaped castings are electrohydroblasting installations comprising generally a base, a bath placed on the base, a mechanism for feeding castings into the bath, an electrode, a mechanism for introducing the electrode into the bath and a pulse current generator coupled electrically with the electrode (see, for example, the British Pat. No. 1,303,223). However, working conditions for personnel tending to these installations are not very favorable, as the high-voltage discharges give rise to a high level of noise, vibrations and a pulse magnetic field, all having a harmful effect upon personnel.

More favorable working conditions are provided at an installation for electrohydroblasting of castings (see Gulyi G. A., Oborudovaniye i tekhnolgicheskiye protsessy s ispolzovaniem elektrogidravlicheskogo effekta /Equipment and Technology Using the Electrohydraulic Effect/, Machinostroeniye Publishers, Moscow, 1977, pp.58–59) which includes an insulated casing formed with a brickwork having doors through which castings are transported to a mechanism for feeding them into a bath. The insulated casing is mounted on a base over the bath and encloses the mechanism for feeding castings into the bath, the electrode, the mechanism for feeding the electrode into the bath and a pulse current generator coupled electrically with the electrode.

In the known installation, the protective insulated casing partly absorbs vibration noise, but fails to guard altogether service personnel against the harmful effect of the pulse magnetic field. In addition, the brickwork has no sufficient resistance to large impact wave loads induced by high-voltage discharges.

SUMMARY OF THE INVENTION

The principal object of the invention is to provide an installation for electrohydroblasting of castings having an insulated casing which is adequately strong and ensures a maximum absorption of the vibration noise and provides shielding of the pulse magnetic field.

Another object of the invention is to provide an installation for electrohydroblasting of castings ensuring better working conditions for attending personnel through the elimination of harmful effects induced by the operation of the installation.

In particular, an object of the invention is to enchance the absorption of the vibration noise and the shielding of the pulse magnetic field.

Still another object of the invention is to provide a greater impact strength of the protective insulated casing of the installation.

The above and other objects of the invention are attained by providing an installation for electrohydroblasting of castings, comprising a base, a bath placed on the base, a mechanism for feeding castings into the bath, an electrode, and a mechanism for introducing the electrode into the bath and an insulated casing enclosing the bath. The mechanism for feeding castings, the electrode and the mechanism for introducing the electrode, being mounted on a base above the bath. The insulated casing is formed with a latticed framework whose openings are covered by slabs, each of which is built of two metallic boxes, one inside the other, so that the ends of one box face a bottom of the other box, with a space formed between the bottoms which is adapted to be filled with a vibration absorbing material, and with the metallic boxes being grounded.

The provision of the insulated casing in the installation for electrohydroblasting of castings in the form of a latticed framework whose openings are covered by metallic boxes filled with a vibration absorbing material ensures maximum absorption of the vibration noise and shielding of the pulse magnetic field and considerably increases the mechanical strength of the insulated casing, whereas metallic slabs on a framework without the vibration absorption material would have only guarded operating personnel against the influence of the pulse magnetic field and provided adequate strength of the structure against large impact wave loads, but would have amplified the vibration noise. From the above it should be recognized that the proposed device makes it possible to solve the problem as a whole and thus considerably improve the working conditions for the operating personnel.

It is advantageous, from the viewpoint of ensuring a complete absorption of the vibration noise, to use a bitumen mastic as the vibration absorbing material of the slabs, which reinforces the casing framework in the installation for electrohydroblasting of castings.

BRIEF DESCRIPTION OF THE DRAWINGS

These and other objects and features of the invention become readily apparent from one embodiment thereof which will now be described by way of example with reference to the accompanying drawings, wherein.

DESCRIPTION OF THE PREFERRED EMBODIMENT

Figure 1:
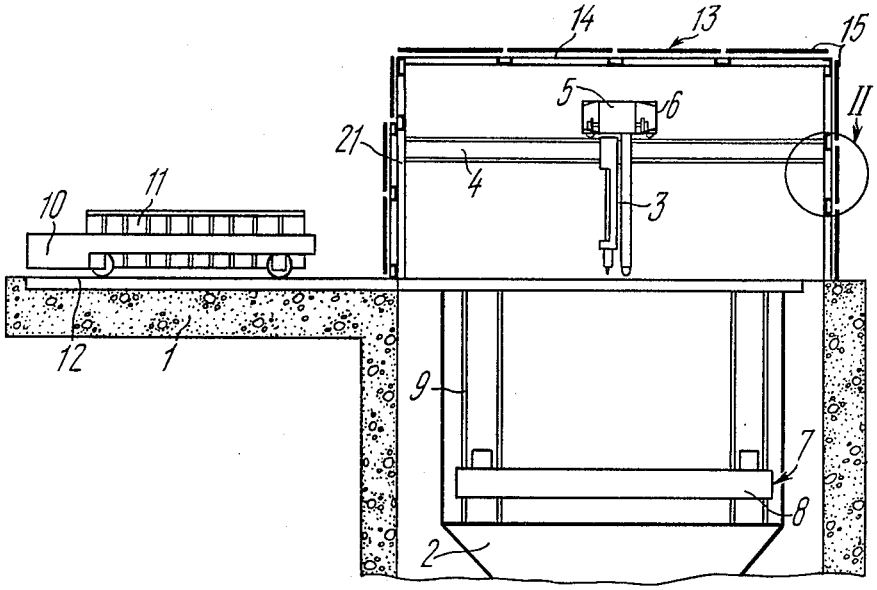
FIG. 1 illustrates diagrammatically an installation for electrohydroblasting of castings, according to the invention.

Referring now to the drawings, and to FIG. 1 in particular, there is shown an installation for electrohydroblasting of castings which comprises a base 1, a bath 2 containing a liquid mounted on the base 1 and an electrode 3. The electrode 3 is fastened in a mechanism 5 for introducing the electrode 3 into the bath 2, which is mounted on a trestle 4 above the bath 2 and electrically connected with a pulse current generator 6. The installation also includes a mechanism 7 for feeding castings into the bath 2 containing the liquid, comprising a mobile platform 8 mounted in two vertical guides 9 provided on both sides of the bath 2 and an actuator connected to the platform by flexible ties (not shown). The actuator is a winch coupled with the platform by a pulley-and-tackle system.

In addition, the installation for electrohydroblasting of castings contains a self-propelling carriage 10 for transporting containers 11 with castings along horizontal guides 12 toward the mechanism 7 for feeding castings into the bath 2 with the liquid.

Figure 2:
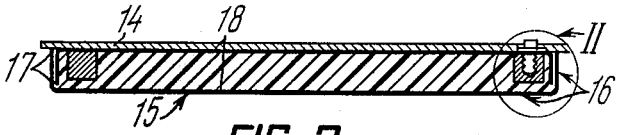
FIG. 2 illustrates in cross section a slab of the insulated casing of the installation for electrohydroblasting of castings, more particularly identified as the subassembly II on FIG. 1.

A noise insulated casing 13, which is provided above the bath 2 on the base 1, encloses the trestle 4 with the electrode 3, the mechanism 5 for introducing the electrode 3 into the bath 2 and the mechanism 7 for feeding castings into the bath 2. The casing 13 incorporates a framework 14 and insulated slabs 15 (see FIG. 2).

The framework 14 is a space lattice built of channels. The openings of this lattice are filled with the insulated slabs 15, not less than one slab 15 per opening of the framework 14.

Each slab 15 is formed with two grounded metallic trough-shaped boxes 16 inserted one inside another in a manner that ends 17 of one box are directed toward a bottom 18 of the other box, and a space is provided between the bottoms 18 so as to be filled with a vibration-absorbing material 19.

Figure 3:
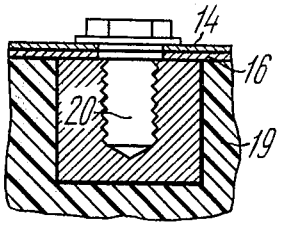
FIG. 3 illustrates an enlarged cross-sectional view of the fastening of a slab to the framework of the insulated casing of the installation for electrohydroblasting of castings.

The vibration-absorbing material 19 may be a liquid rubber, but the best effect, from the viewpoints of both vibration noise absorption and low cost, is attained by using a bitumen mastic. As shown on FIG. 3, the slabs have blind openings 20 for fasteners securing them to the framework 14 of the insulated casing 13. The insulated casing 13 has doors 21 for transporting castings on the self-propelling carriage toward the platform 8.

OPERATION

The installation for electrohydroblasting of castings operates as follows.

The container 11 with a casting or castings is placed on the carriage 10 (see FIG. 1) spotted in the loading-unloading position. Once the container 11 has been placed, the carriage 10 is moved along the horizontal guides 12 toward the mechanism 7 for feeding castings into the bath 2, the platform 8 of the mechanism 7 passing underneath the carriage 10 and lifting the container 11 above the carriage 10 by its stops (not shown) provided in the platform for this purpose. The carriage 10 then rolls in the reverse direction to permit the platform 8 with the container 11 to be lowered freely into the bath 2. In its bottom position, the container 11 with castings is fully immersed into the bath 2 with the working liquid. An operator then manipulates the mechanism 5 for introducing the electrode 3 into the bath 2 to bring the electrode 3 toward the immersed container 11 with castings.

Pulse high-voltage discharges, induced between the electrode 3 and a casting, cause, according to a known process, deposits of core and moulding sands contaminating the casting to break up. The vibration noise and the pulse magnetic field accompanying the high-voltage discharges are practically fully absorbed by the insulated slabs 15 of the insulated casing 13 (see FIGS. 1, 2, 3). The vibration absorbing material 19 (liquid rubber and, in particular, bitumen mastic) is capable of withstanding considerable dynamic alternating loads, this predetermining on the whole a greater strength and durability of the device.

Thus, personnel serving the installation for electrohydroblasting of castings are protected against the harmful effect of the vibration noise and the pulse magnetic field.

Once the casting or castings have been cleaned, the platform 8 with the container 1 is lifted by the actuator along the guides 9 into the extreme top position. Next, a transfer mechanism (not shown in the drawing) of the container 11, for example, a conveyor, takes over the container 11 with the castings and transports it to the loading-unloading position. At the same time, the self-propelling carriage 10 brings a next container 11 with castings toward the platform 8, and the cycle is repeated.

It is to be understood that the form of the invention, herewith shown and described, is to be taken as a preferred embodiment, and that various changes in the shape, size and arrangement of parts may be resorted to, without departing from the scope of the invention, or the scope of the claims set forth hereinbelow.

What is claimed is:

1. In an improved installation for electrohydroblasting of castings having a base; a bath mounted on said base; a mechanism for feeding castings into the bath including a lift platform located near the bath; an electrode located over said bath; a mechanism mounted on a trestle for transporting and introducing said electrode into said bath; and a pulse current generator coupled electrically with said electrode; said improvement comprising: a noise-insulated casing having a substantially closed profile, including a space lattice framework having rows of openings, mounted on said base over said bath and enclosing the bath, the trestle and electrode, and the mechanisms for feeding castings and for transporting and introducing the electrode into the bath; a plurality of grounded slabs each formed with two metallic boxes, each having a bottom and sides, inserted one into another in a manner that the ends of the sides of one box face a bottom of the other box, with the space between the bottoms filled with a vibration-absorbing material, and being capable of guarding service personnel against a pulse magnetic field and of withstanding considerable dynamic alternating loads, and the openings in said space lattice framework receiving and retaining in place said slabs; whereby both the harmful effects of vibration noise and the pulse magnetic field are substantially avoided with the use of said framework and said grounded slabs.

2. An installation for electrohydroblasting of castings as claimed in claim 1, wherein the vibration-absorbing material is a bitumen mastic.

3. The improvement according to claim 1, wherein said vibration-absorbing material is liquid rubber.

4. The improvement according to claim 1, wherein each of said openings of said space lattice framework is capable of receiving and retaining in place at least one slab.

5. The improvement according to claim 1, wherein said space lattice framework is made of channels, and said slabs are secured to said framework by fastening means.

6. The improvement according to claim 5, including blind openings in said slabs for receiving said fastener means.

7. The improvement according to claim 1, wherein said noise-insulated casing is provided with doors for the passage of a track-guided, self-propelled carriage supporting a plurality of containers holding said castings.

8. The improvement according to claim 1, wherein said vibration-absorbing material is a high viscosity-fluid capable of insulating against noise and of adhering firmly to said slabs and preventing their vibration from the effects of a pulsed magnetic field.

* * * * *